US006568548B1

(12) United States Patent
Minnette et al.

(10) Patent No.: US 6,568,548 B1
(45) Date of Patent: May 27, 2003

(54) CLOSURE WITH TAMPER-INDICATING BAND

(75) Inventors: Jeffrey C. Minnette, Evansville, IN (US); Gary V. Montgomery, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/883,564

(22) Filed: Jun. 18, 2001

Related U.S. Application Data

(60) Provisional application No. 60/212,619, filed on Jun. 19, 2000.

(51) Int. Cl.[7] ..... B65D 41/34
(52) U.S. Cl. ..... 215/252; 215/258
(58) Field of Search ..... 215/252, 258, 215/318; 264/268

(56) References Cited

U.S. PATENT DOCUMENTS 4,478,343 A * 10/1984 Ostrowsky ..... 215/252
5,450,972 A * 9/1995 Zemlo ..... 215/252
5,564,582 A * 10/1996 Kamath ..... 215/252
5,609,263 A * 3/1997 Perchepied ..... 215/252
5,715,959 A * 2/1998 Pfefferkorn et al. ..... 215/252
5,813,553 A * 9/1998 Herr et al. ..... 215/252
5,979,682 A * 11/1999 Zumbuhl ..... 215/252

FOREIGN PATENT DOCUMENTS

EP 1155966 A1 * 11/2000 ..... 215/252
JP 6-199356 * 7/1994 ..... 215/252

* cited by examiner

*Primary Examiner*—Robin Hylton
(74) *Attorney, Agent, or Firm*—John F. Salazar; Middleton Reutlinger

(57) ABSTRACT

A plastic safety closure with a tamper-indicating band is described. The closure includes a tamper-indicating band depending from the skirt of the closure. The tamper indicating band includes a frangible portion with one or more openings therein. The openings may form an interrupted slot or a continuous slot. Each opening includes a lip projecting outwardly therefrom and another lip projecting inwardly therefrom. These lips provide greater contacting area at the inner surface of the opening, thereby facilitating the alignment of the lower portion of the tamper-indicating band as it is forced into position on a container fitment.

17 Claims, 12 Drawing Sheets

CLOSURE WITH TAMPER-INDICATING BAND

This utility patent application claims priority to provisional patent application No. 60/212,619, filed on Jun. 19, 2000.

BACKGROUND OF THE INVENTION

1. Technical Field

This invention relates generally to a closure with a tamper-indicating band. More particularly, this invention relates to a novel closure with a tamper indicating band wherein both the closure and the tamper indicating band include flared end portions that assist in the attachment of the closure to a container fitment.

2. Prior Art

It is often desirable to provide a container closure that includes tamper-indicating features whereby the initial opening of the container is discernable from the condition of the closure. The use of plastic closures with frangible bands having tamper-indicating features are known in the art. Such safety closures incorporate tamper-indicating bands that both are integrally formed to the closure and include a removable, detachable or frangible portion thereof which must be broken or separated from the closure in order to initially open the closure. As stated, such tamper-indicating bands are integrally formed with the closure during the molding process. Such a closure, with a tamper-indicating band, is initially attached to the fitment of a container so that the container is securely closed and the tamper-indicating band engaged to the fitment. Normally, the engagement of the tamper-indicating band and the container fitment is achieved by slidably positioning the band over one or more retention beads projecting from the container fitment. Once the tamper-indicating band is so positioned relative to the retention bead, the band must then be broken or separated from the closure in order to open the container.

Depending upon the design of the tamper-indicating band, some difficulties may arise in the proper placement of the band relative to the container fitment. Namely the frangible portions of a band tend to be so flexible as to allow for the misalignment of the band as its being positioned on the container fitment. Therefore, it is desirable to provide a plastic closure having a tamper-indicating band that is so structured as to facilitate the proper alignment of the band during its positioning on the container fitment.

SUMMARY OF THE INVENTION

It is an object of the present invention to provide a plastic closure including an integrally formed tamper-indicating band.

It is another object of the present invention to provide a closure with a tamper-indicating band having features that aid in the alignment of the band relative to a container fitment.

More particularly, the present invention is directed to a plastic closure having a tamper-indicating band with one or more openings defining the frangible portion thereof. Each opening includes at least one outwardly projecting lip that projects from the circumference thereof and at least one similar inwardly projecting lip. The lips of the openings provide increased surface contact at the inner surfaces of the openings, thereby providing greater contact pressure between the upper and lower portions of the tamper-indicating band when the band is being forced into place.

More specifically, as the lower portion of the tamper-indicating band is being forced over the retention beads of the container fitment, the plastic band tends to flex at its weakest points. The weakest points tend to be the frangible bridge segments or ribs that connect the lower portion of the band to the upper portion thereof. The openings that define this frangible area tend to collapse or distort in such a way that the upper and lower portions of these openings tend to contact with each other as the lower portion of the band is being forced over the retention beads. The greater contact between the upper and lower portions of the tamper-indicating band provides for a more stable alignment of the lower portion thereof as it is forced over the retention bead, thereby facilitating the attachment of the closure to the container fitment.

It will become apparent that other objects and advantages of the present invention will be obvious to those skilled in the art upon reading the detailed description of the preferred embodiment set forth hereinafter.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
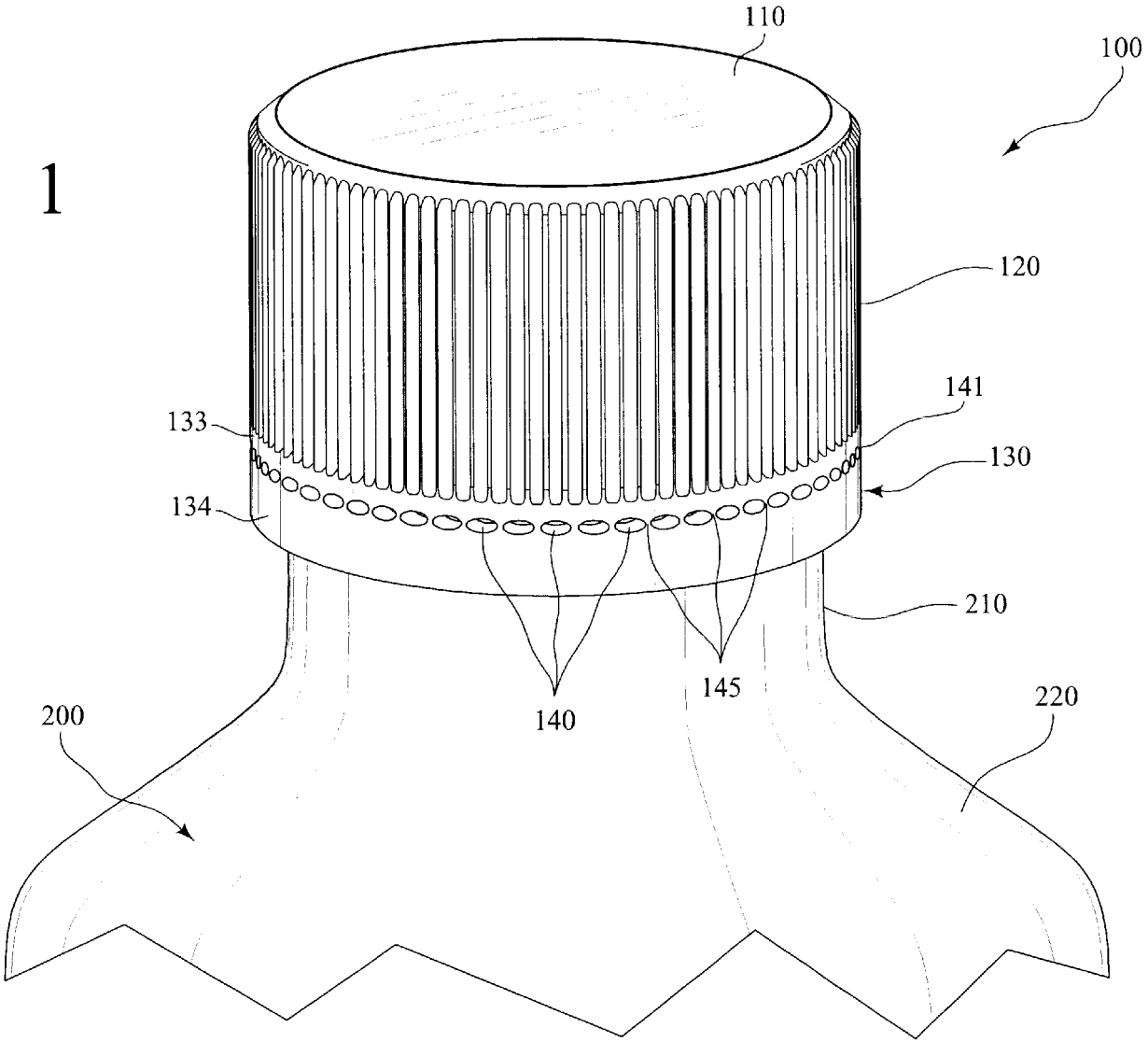
FIG. 1 is a perspective view of a closure with a tamper-indicating band of one preferred embodiment of the present invention.

With reference to FIG. 1, a closure 100 according to a preferred embodiment of the present invention is provided for threading engagement to the fitment of a container 200 having a neck portion 210 projecting upward from a body portion 220. The closure 100 includes a top wall 110 with a skirt 120 depending therefrom. A tamper-indicating band 130 is integrally molded with a lower end of the skirt 120 and includes a plurality of frangible bridge segments 145 connecting the lower portion 134 of the band 130 to the upper portion 133 thereof. Upper portion of the tamper indicating band 133 is coextensive with the lower portion of the annular skirt 120 and depends directly there below to frangibly connect the skirt to the lower portion of the band 134. The frangible bridge segments 145 of the band 130 are separated by a plurality of openings 140 formed in the band 130. The openings 140 are formed by the use of a knife, water jet, laser or other cutting mechanism by the focusing and directing of energy or mass. The openings 140 form an interrupted slot that may circumscribe the tamper-indicating band 130. Each opening 140 includes at least one lip 141 projecting therefrom. In the case of each opening 140, each lip 141 projects around the total circumference of the outer edge of the opening 140.

Figure 2:
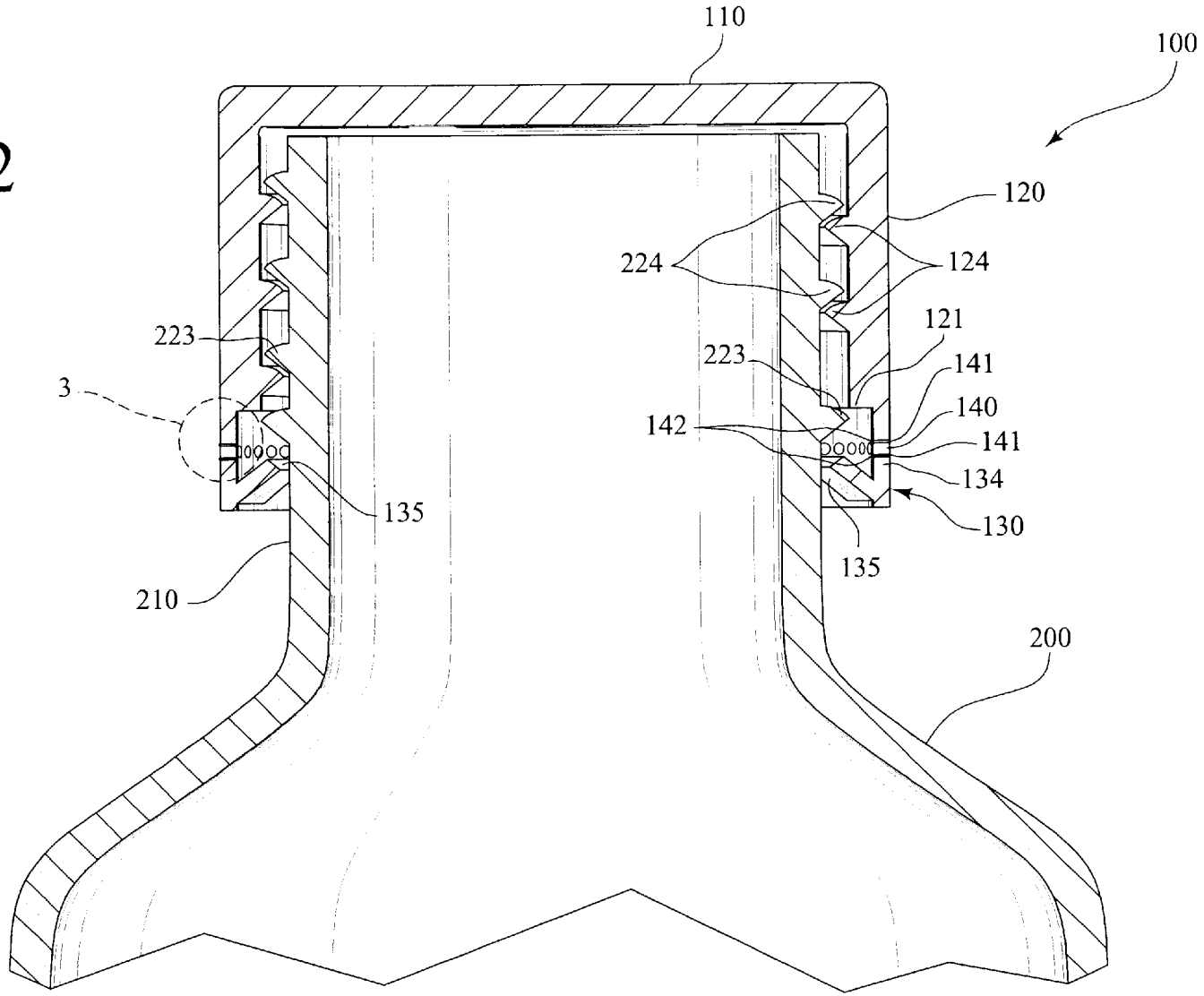
FIG. 2 is a sectional view of the closure of FIG. 1.

As shown in FIG. 2, the closure 100 is fully attached to the container fitment 200 by the engagement of thread 124, which projects inwardly from the inner surface of skirt 120, with thread 224, which projects outwardly from the outer surface of neck portion 210. Tamper-indicating band 130 projects from the lower end 121 of skirt 120 and includes a plurality of retention tabs 135 or other inwardly directed retention mechanism, that may also project upwardly from the inner surface of tamper-indicating band 130. Openings 140 are located between the upper portion 133 and the lower portion 134 of band 130. Each opening 140 has a lip 141 that projects from the outer surface of the band 130 and a lip 142 that projects inwardly from the band 130. As shown in FIG. 2, retention tab 135 is positioned below retention bead 223 when the closure 100 is fully attached to the container fitment 200, so that when the closure 100 is initially removed from the container retention tab 135 engages retention bead 223, preventing movement of tamper-indicating band 130 and eventually causing the breaking of frangible bridge segments 145.

Figure 3B:
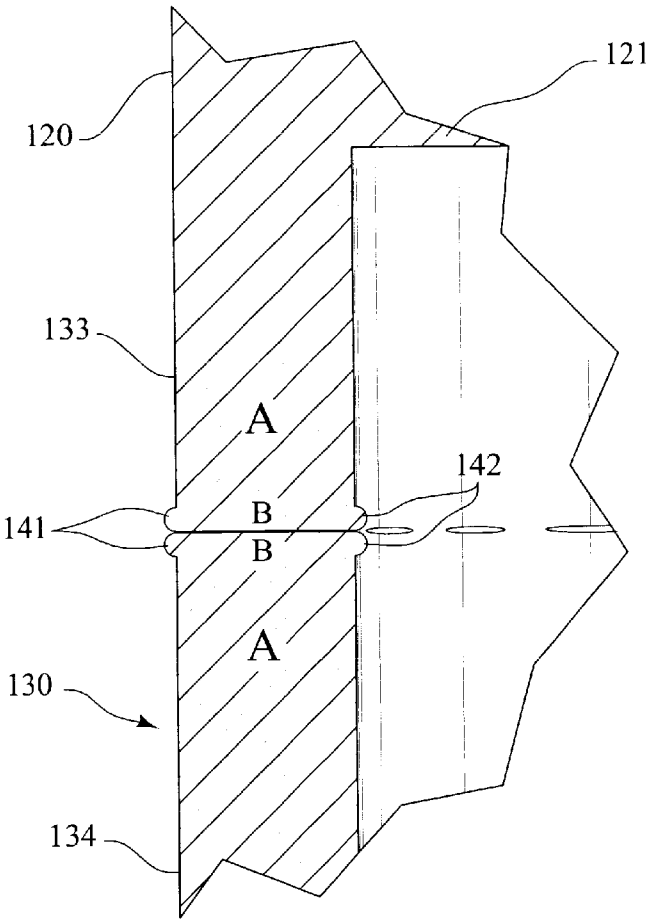
FIG. 3*b* is a sectional view of the portion of the closure shown in FIG. 3*a* as downward force is applied to the closure.
Figure 3A:
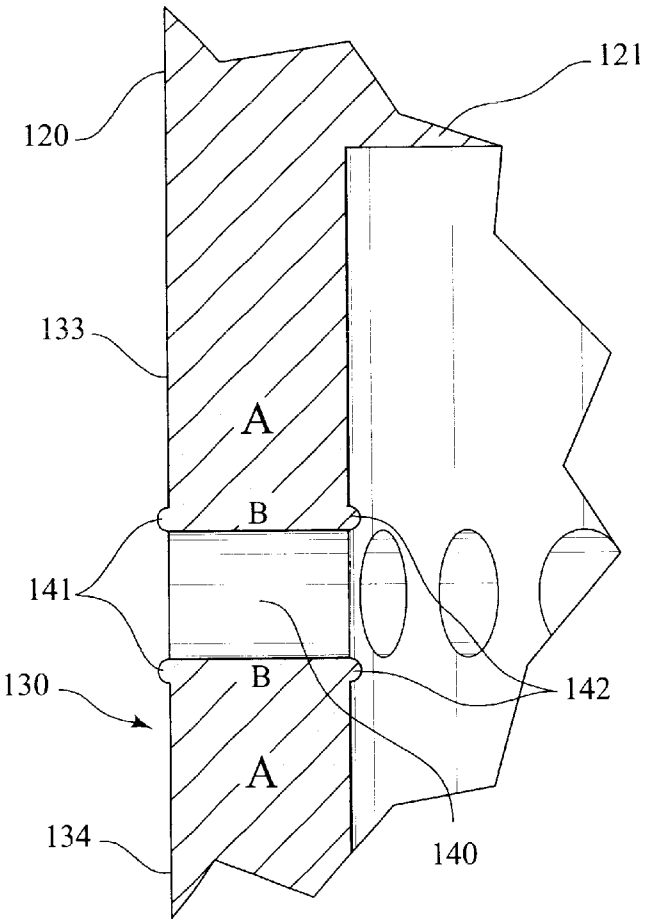
FIG. 3*a* is a sectional view of a portion of the closure of FIG. 2 encircled by line 3—3.
Figure 4:
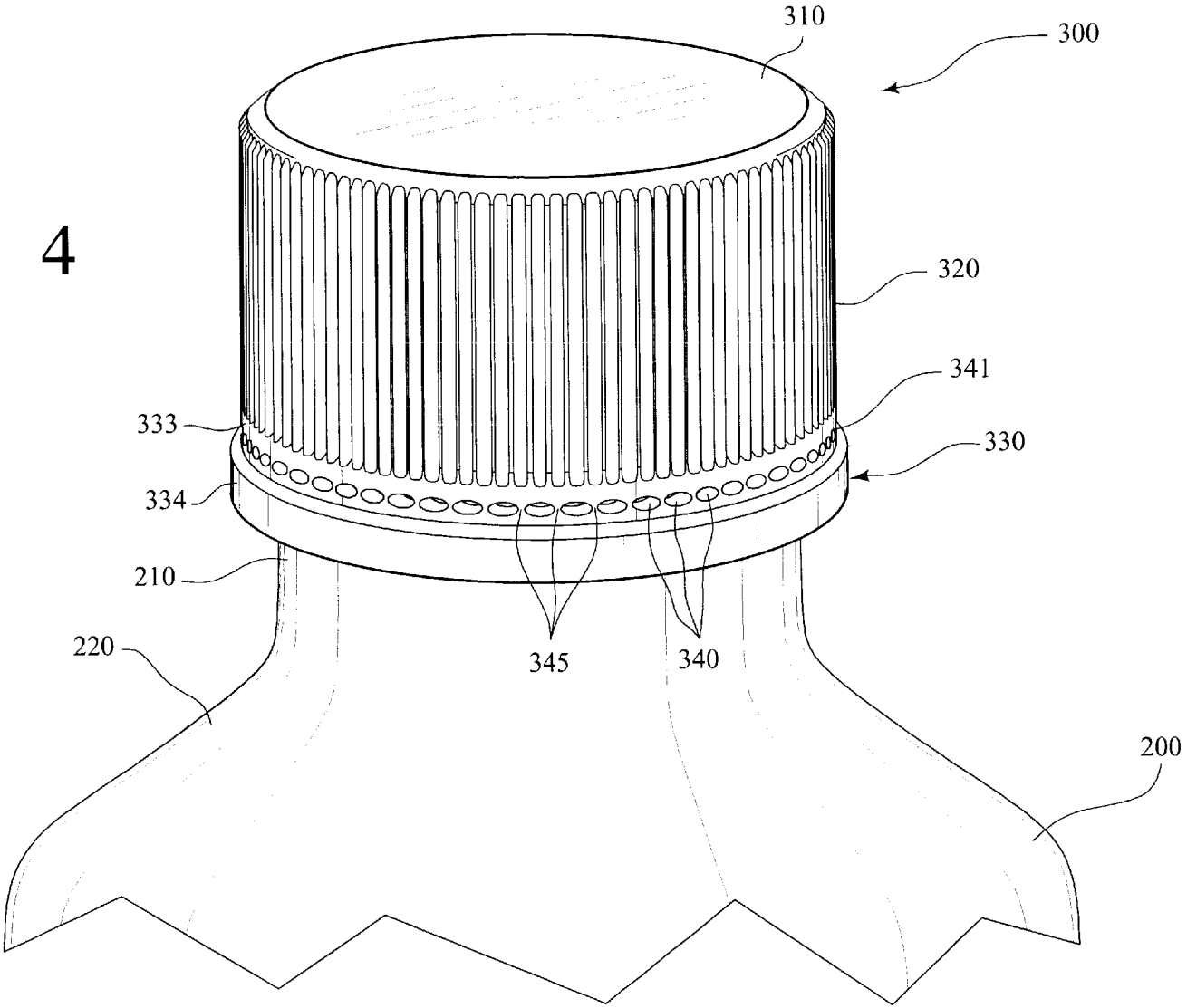
FIG. 4 is a perspective view of a closure with a tamper-indicating band of another embodiment of the present invention.
Figure 5:
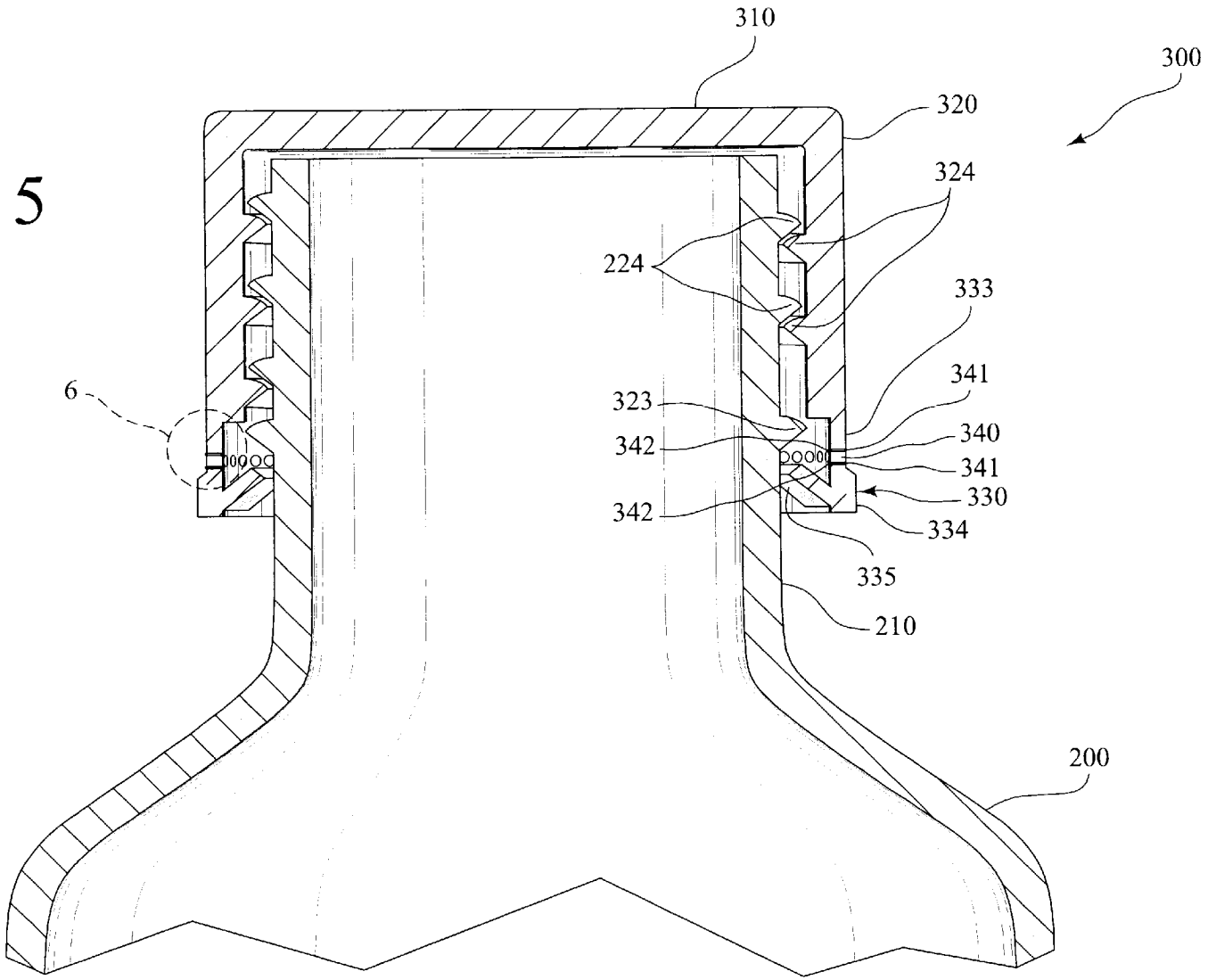
FIG. 5 is a sectional view of the closure of FIG. 4.

FIGS. 3*a* and 3*b* show a detailed portion of tamper-indicating band 130 taken along line 3—3. Opening 140 has an outward lip 141 and an inward lip 142 both projecting therefrom. As indicated by diameter A, both the upper portion 133 and the lower portion 134 of band 130 each include a section with a diameter A. Both upper portion 133 and lower portion 134 also have sections with a diameter B defined by lips 141 and 142. The sections of each portion 133 and 134 of band 130 with diameter B are adjacent to the inner surface of opening 140. As shown in FIGS. 3*a* and 3*b*, diameter A is less than diameter B. When closure 100 is initially attached to container fitment 200, tamper-indicating band 130 is distorted as retention tab 135 is forced over retention bead 223. The distortion of bead 130 tends to occur in the vicinity of openings 140. The circumference of opening 140 tends to be distorted in such a way that the lower portion 134 and the upper portion 133 of band 130 tend to contact each other at the sections with diameter B. These sections with diameter B of upper portion 133 and lower portion 134 provide a greater area of contact than would be provided in the absence of lips 141 and 142. As a consequence, the lower portion 134 of band 130 is less likely to roll out of alignment, either inwardly or outwardly, as tamper-indicating indicating band 130 is forced past retention bead 223, since sections with diameter B provide greater contact as downward force is applied to the closure 100.

Figure 6B:
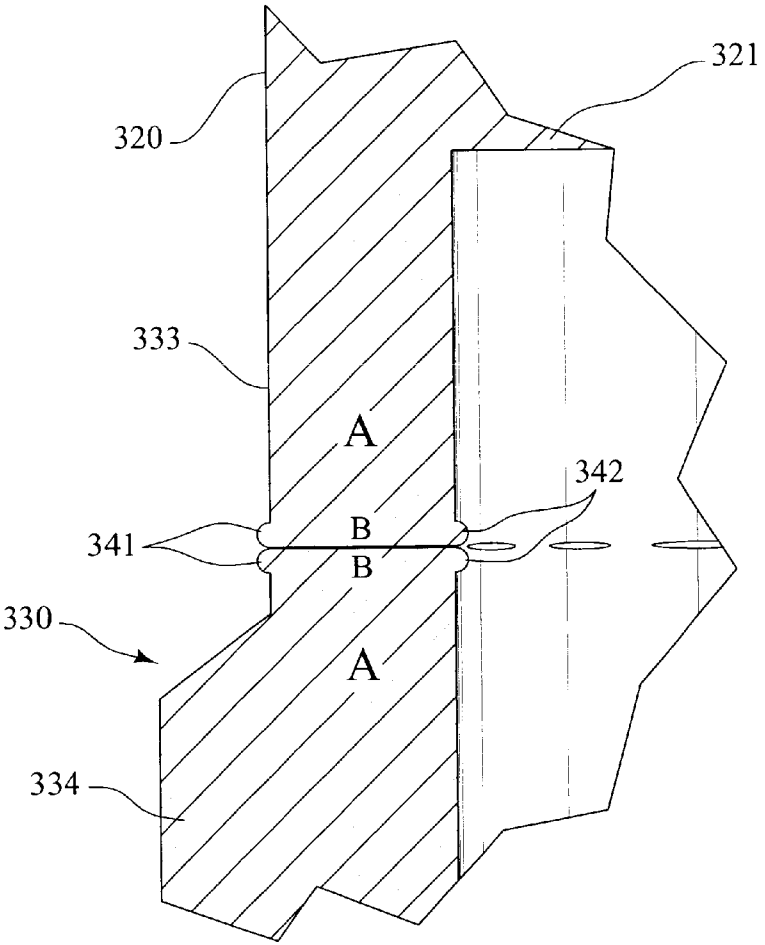
FIG. 6*b* is a sectional view of the portion of the closure shown in FIG. 5*a* as downward force is applied to the closure.
Figure 6A:
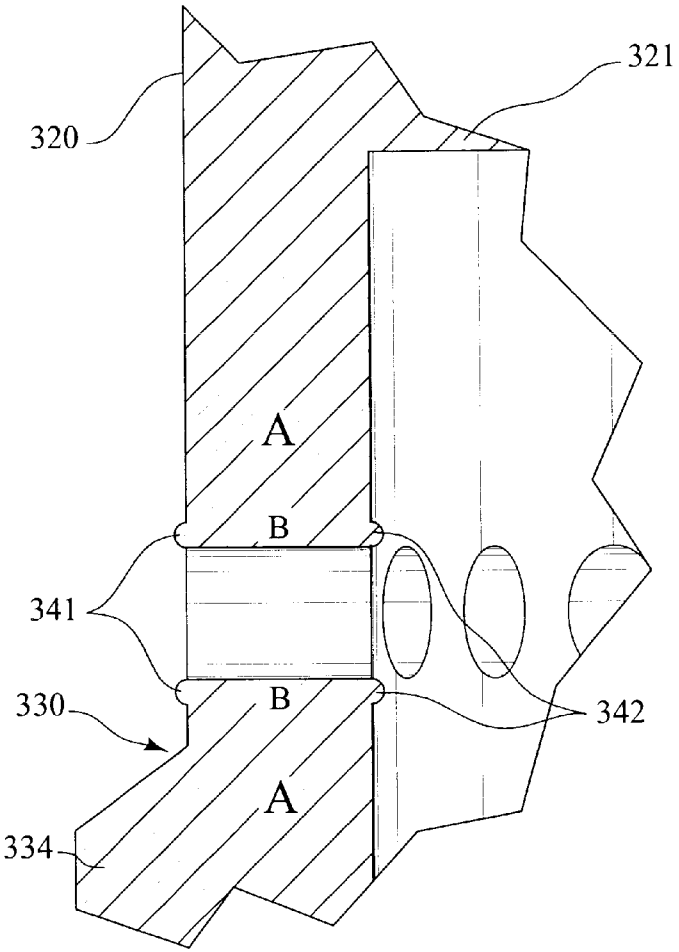
FIG. 6*a* is a sectional view of a portion of the closure of FIG. 5 encircled by line 5—5.
Figure 7:
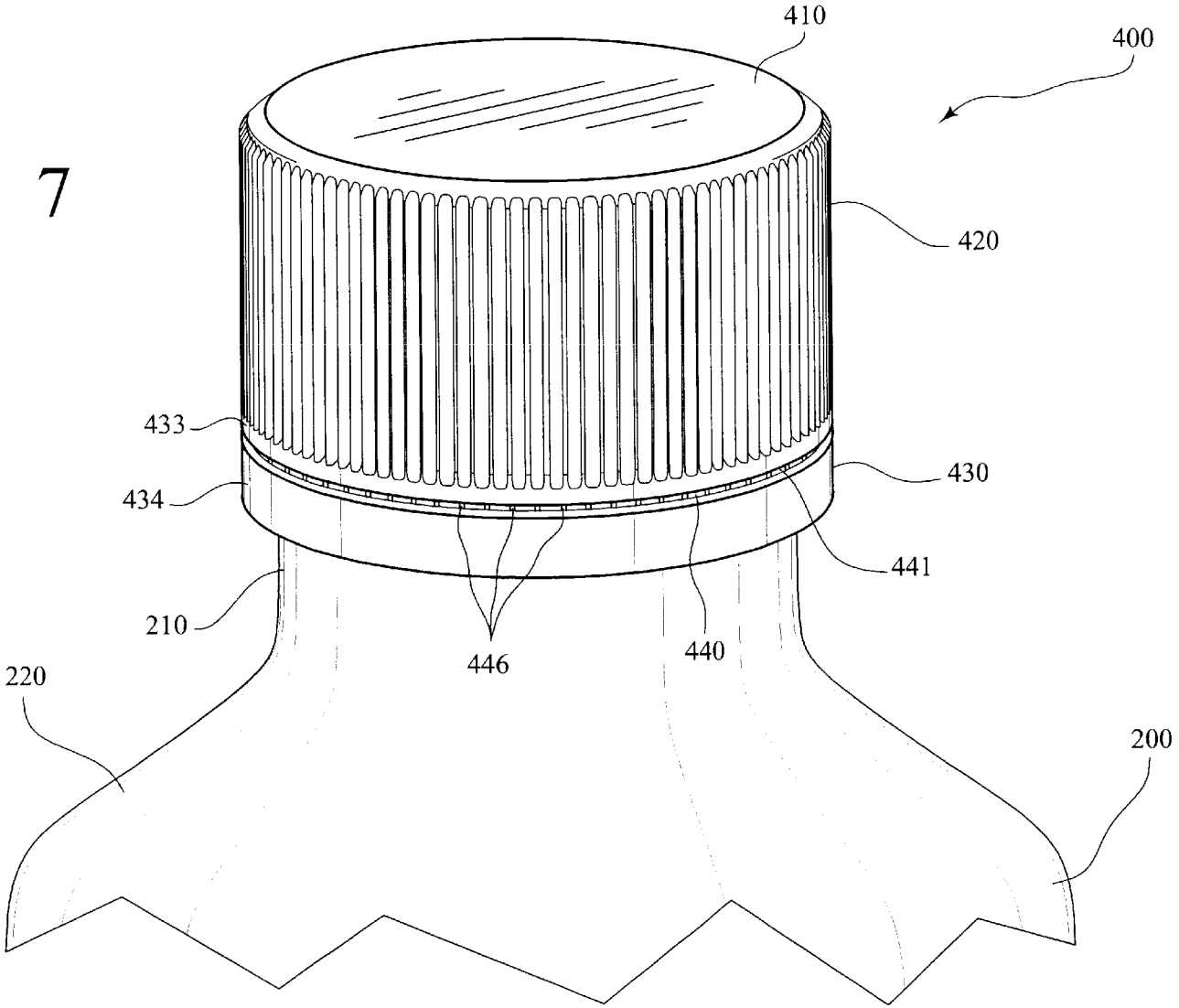
FIG. 7 is a perspective view of another embodiment of the closure of the present invention.
Figure 8:
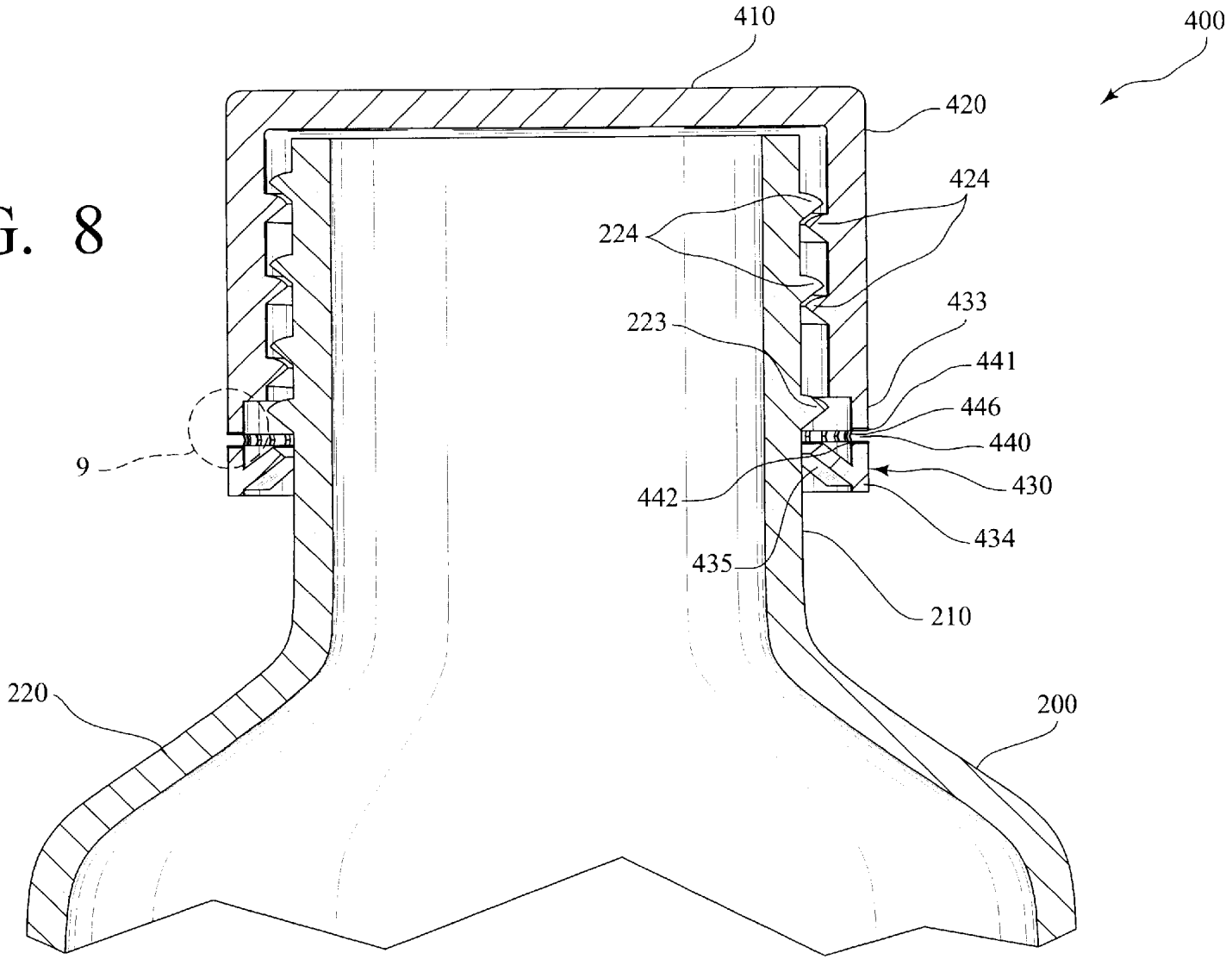
FIG. 8 is a sectional view of the closure of FIG. 7.
Figure 9B:
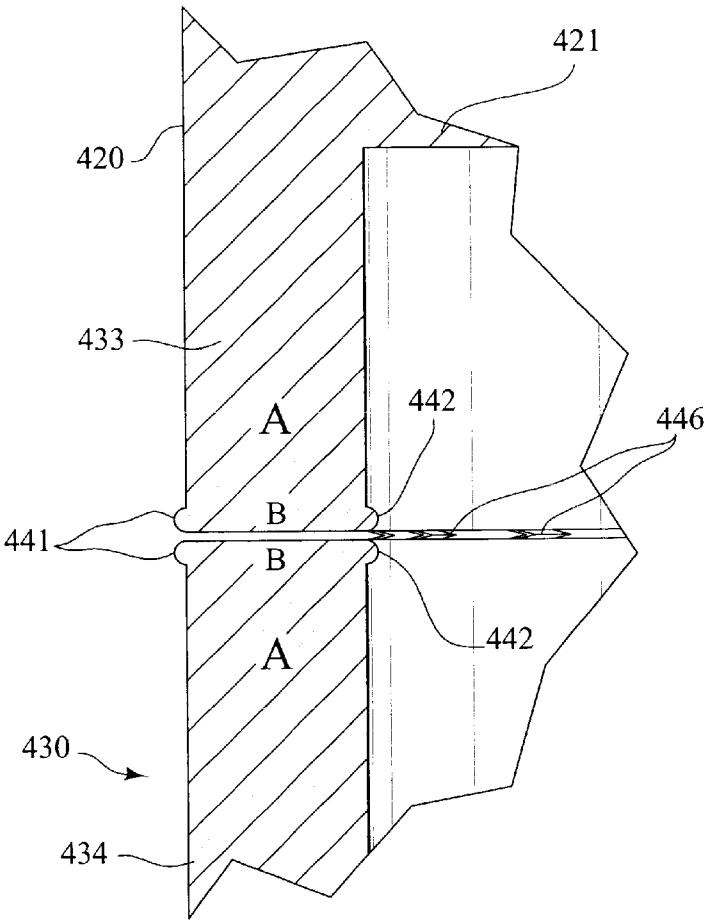
FIG. 9*b* is a sectional view of the portion of the closure shown in FIG. 9*a* as downward force is applied to the closure.
Figure 9A:
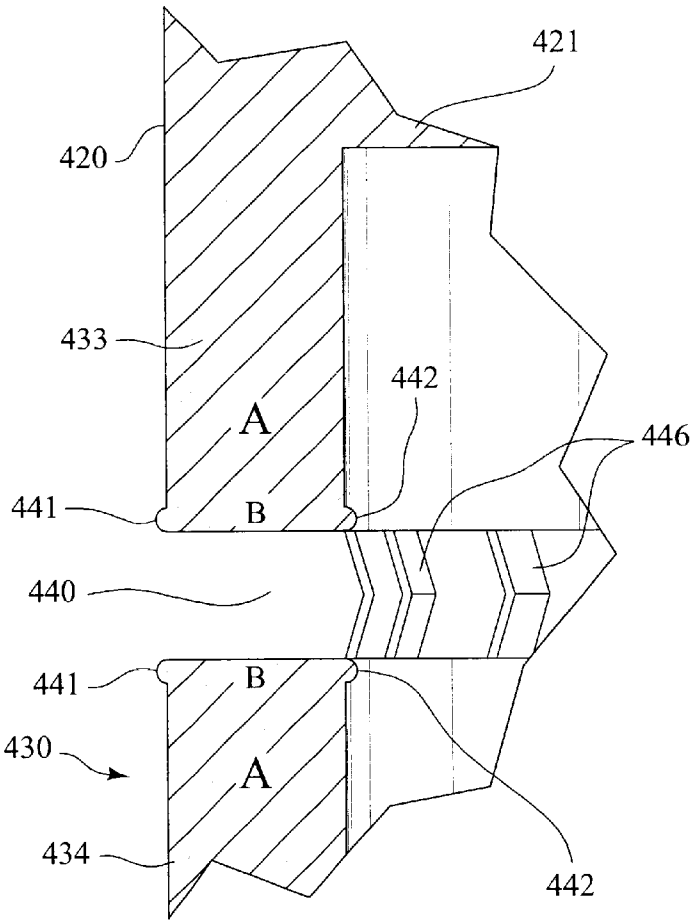
FIG. 9*a* is a sectional view of a portion of the closure of FIG. 8 encircled by line 9—9.
Figure 10:
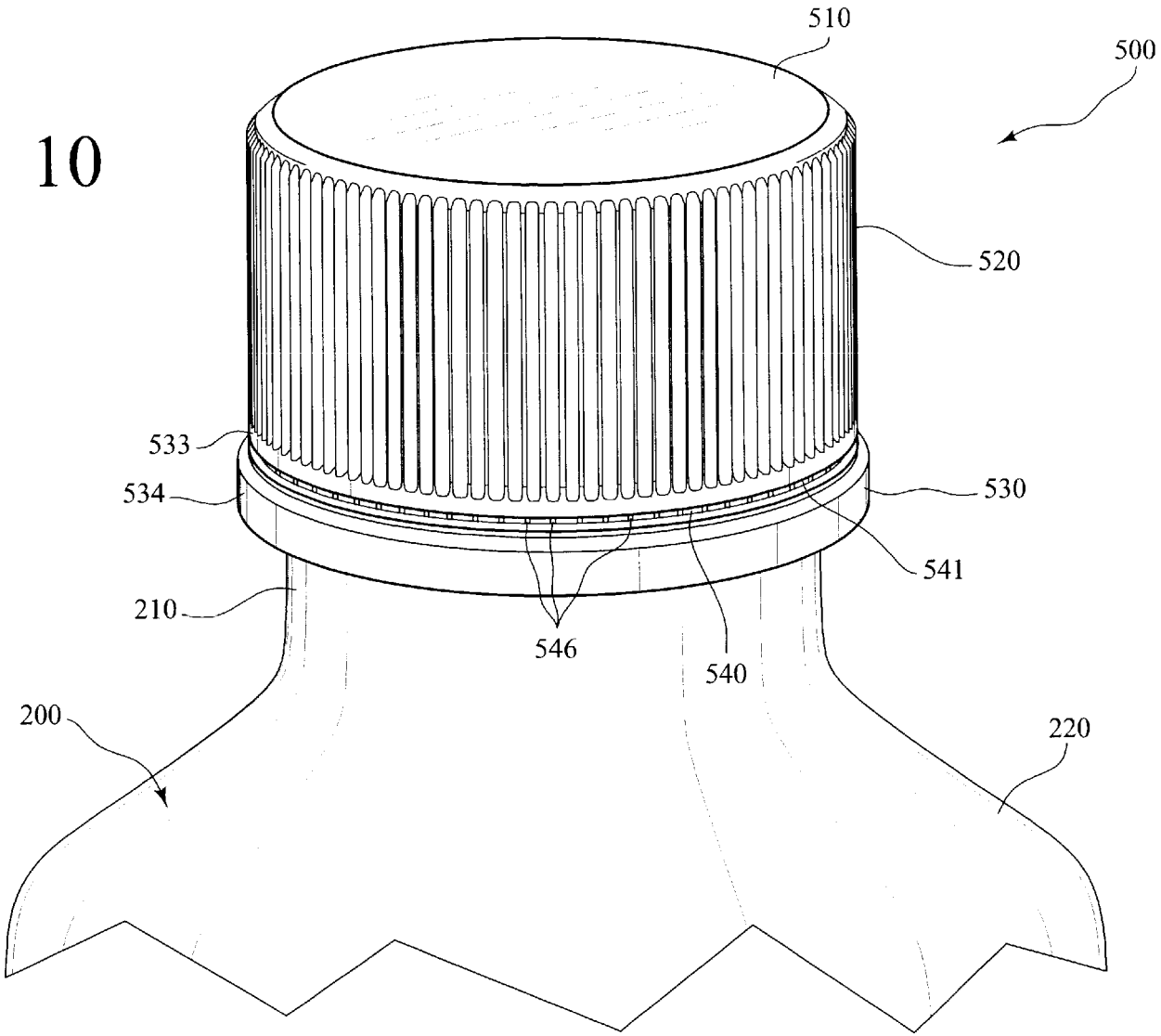
FIG. 10 is a perspective view of still another embodiment of the closure of the present invention.
Figure 11:
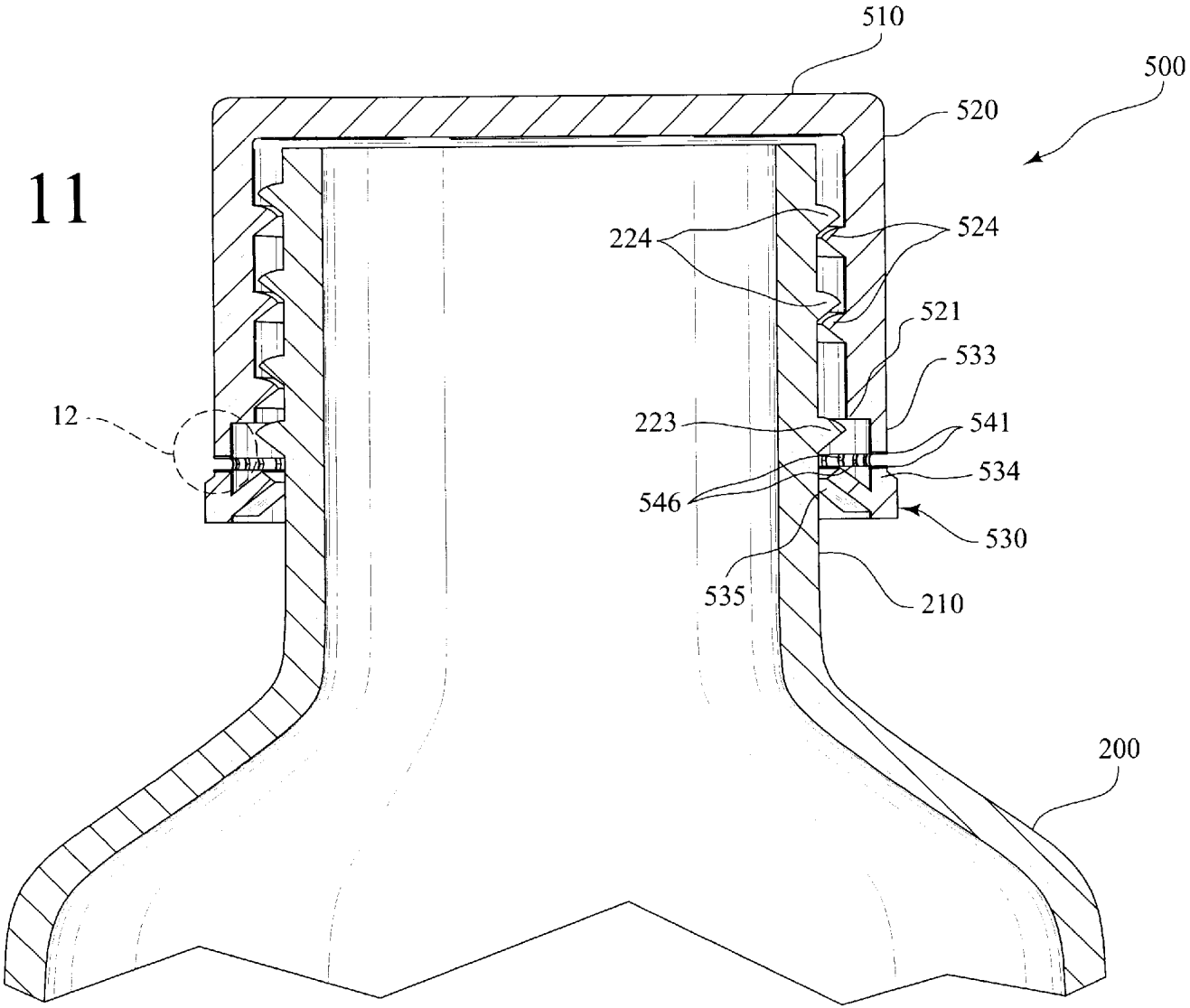
FIG. 11 is a sectional view of the closure of FIG. 10.
Figure 12B:
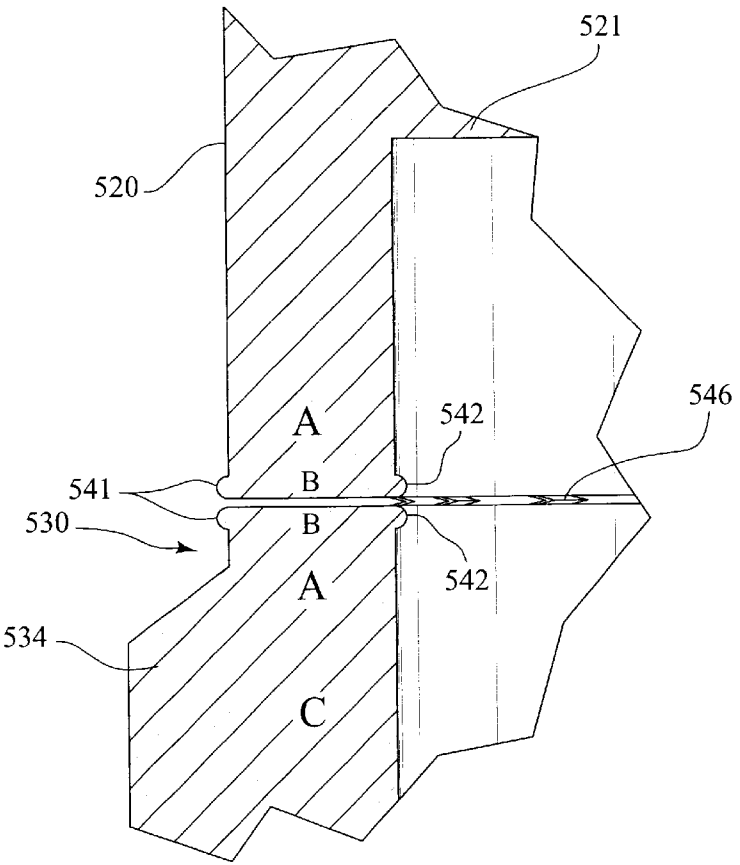
FIG. 12*b* is a sectional view of the portion of the closure shown in FIG. 12*a* as downward force is applied to the closure.
Figure 12A:
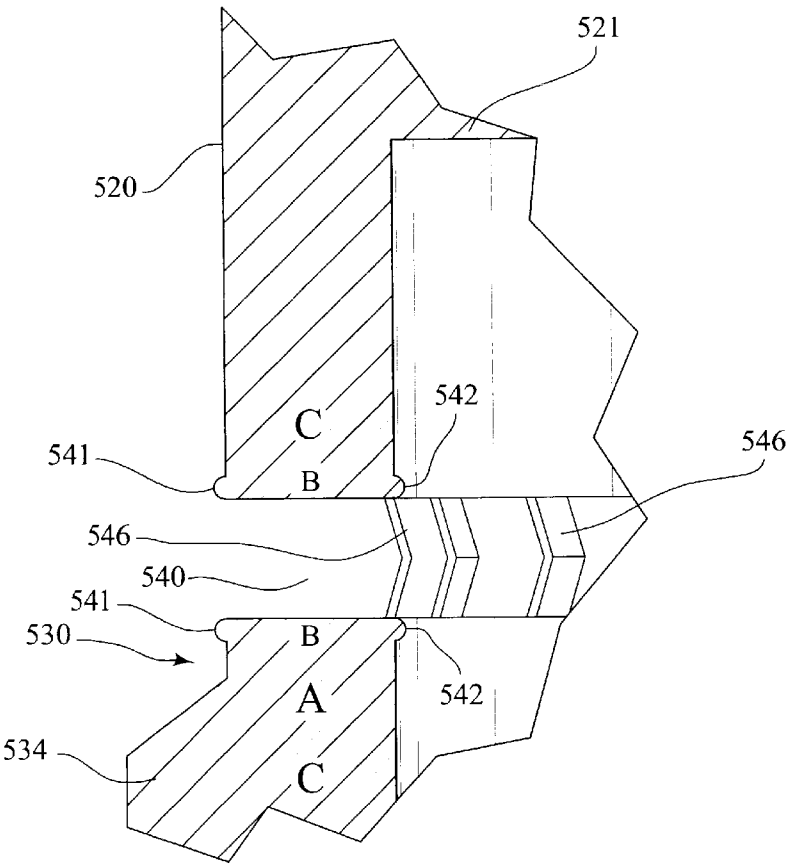
FIG. 12*a* is a sectional view of a portion of the closure of FIG. 11 encircled by line 12—12.

FIGS. 4–6*a* show another embodiment of the closure of the present invention. A closure 300 with a tamper-indicating band 330 is provided. All aspects of this embodiment are similar or identical to that of the closure 100, except that the lower portion of tamper-indicating band 330 includes a lower section with a diameter C, as shown in FIG. 6*a*. Diameter C is greater than both diameter A and diameter B of upper and lower sections 333 and 334. As with closure 100, when closure 300 is being initially attached to container fitment 200, opening 341 of tamper-indicating band 330 is distorted so that the upper portion 333 and the lower portion 334 of the band contact each other. The sections of each portion 333 and 334 having diameter B contact each other, thereby providing greater contact through which increased contact pressure e is applied to lower portion 334 than would otherwise be available in the absence of outward projecting lip 341 and inward projecting lip 342. In this manner, the positioning of tamper-indicating band 330 on container fitment 200 is facilitated.

FIGS. 7–9*b* show yet another embodiment of the safety closure of the present invention. In this embodiment, closure 400 includes a tamper-indicating band depending from the lower section 421 of the skirt 420 of the closure. However, unlike closure 100 and 300, the tamper-indicating band 430 includes one opening, or continuous slot, 440 that circumscribes the band 430. The lower portion 434 of band 430 is frangibly attached to the upper portion thereof by a plurality of ribs 446. Ribs 446 are attached to the inner surfaces of the upper and lower portions 433 and 434 of the tamper-indicating band 430. As with closures 100 and 300, closure 400 is threadably attached to a container fitment 200. Likewise, tamper-indicating band 430 may include a plurality of retention tabs 435 projecting inwardly therefrom and which engage retention beads 232 which project outwardly from the outer surface of the neck portion 210 of the container fitment 200. Also, tamper-indicating band 430 has upper and lower portions 433 and 434 with sections with diameters A and B, as shown in FIG. 9*a*. The sections with diameter B include outwardly projecting lips 441 and inwardly projecting lips 442. Lips 441 and 442 project from opening 440 around the circumference of band 430. When downward force is applied to the closure 400 so as to force the retention tabs 435 over retention beads 232 as the closure 400 is being initially attached to container fitment 200, ribs 446 are compressed and opening 440 is distorted, thereby bringing upper portion 433 into contact with lower portion 434. The sections of these portions with diameter B contact each other thereby providing a surface contacting area through which downward force may be applied.

FIGS. 10–12*b* show another embodiment of the present invention with another continuous slot 540 defined in the tamper-indicating band 530. As with the closure 300, the lower portion 534 of the tamper-indicating band 530 includes a section having a diameter C, which is greater than diameter A and diameter B. Diameter B is defined by the lips 541 and 542 which project outwardly and inwardly, respectively, along the edge of the opening 540. As with the other embodiments of the present invention, diameter A is less than diameter B. The greater surface contact provided by the contacting of the upper portion 533 and the lower portion 534 of the tamper-indicating band 530, provides for increased contact pressure and better alignment of the band 530 over the retention bead 232 than would be available in the absence of lips 541 and 542. Ribs 546 are provided to frangibly connect upper portion 533 and lower portion 534 of the tamper indicating band.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. A tamper indicating closure, comprising:

a top wall and annular depending side wall;

a tamper indicating band frangibly connected to a lower portion of said depending side wall along an upper portion, thereof wherein said lower portion of said side wall has at least one lip formed there on, said upper portion of said tamper indicating band having at least one lip formed thereon, said at least one lip of said depending side wall facing said at least one lip on said tamper indicating band;

an inwardly directed retention mechanism on said tamper indicating band;

wherein said at least one lip formed on said depending side wall and said at least one lip formed on said tamper indicating band is an inwardly extending lip on said side wall and an inwardly extending lip on said tamper indicating band and an outwardly extending second lip on said side wall and an outwardly extending second lip on said tamper indicating band.

2. The tamper indicating closure of claim 1 wherein said inwardly extending lips and said outwardly extending lips in combination with said annular skirt and said tamper indicating band form first and second opposing facing surfaces which increase the surface contact of opposing surfaces of said upper portion of said tamper indicating band and said lower portion of said annular skirt.

3. The tampering indicating closure of claim 2 wherein said closure side wall and said tamper indicating band are connected by a plurality of frangible bridge segments.

4. The tampering indicating closure of claim 2 wherein said closure side wall and said tamper indicating band are connected by a plurality of rupturable ribs.

5. The tamper indicating closure of claim 4 wherein said tamper indicating band is separated from said side wall by a circumscribing slot, said ribs extending vertically along an inner surface of said side wall and said tamper indicating band.

6. The tamper indicating band of claim 2 wherein said first and said second opposing facing surfaces have a first thickness, said annular side wall and said tamper indicating band having a second thickness.

7. A closure having a tamper indicating band, comprising:

a top wall and depending skirt, said depending skirt having a lower portion;

a tamper indicating band frangibly connected to said depending skirt and having an inwardly directed retention mechanism;

wherein said lower portion of said skirt and said tamper indicating band have outwardly and inwardly extending lips, said lips and said tamper indicating band and said lips and said skirt forming opposing surfaces, said opposing surfaces having an increased thickness compared to said lower portion of said skirt and said tamper indicating band.

8. The closure of claim 7 wherein said opposing surfaces of said tamper indicating band, said skirt and said lips have a first thickness, said first thickness greater than a thickness of said lower portion of said skirt and of said tamper indicating band.

9. The closure of claim 8 wherein said thickness of said lower portion of said skirt and said tamper indicating band is a second thickness, said second thickness less than said first thickness.

10. The closure of claim 9 wherein said tamper indicating band has a lower section, said lower section having a third thickness, said third thickness greater than said first thickness and said second thickness.

11. The closure of claim 9 wherein said skirt and said tamper indicating band are frangibly connected by a plurality of rupturable bridge segments.

12. The closure of claim 9 wherein said skirt and said tamper indicating band are separated by a continuous circumferential slot and frangibly connected by a plurality of ribs formed on an interior surface of said skirt and said tamper indicating band.

13. A closure with a tamper indicating band, comprising a top wall and depending side wall frangibly connected to a tamper indicating band, said tamper indicating band having an upper portion, said side wall having a lower portion, a first lip and second lip formed on opposed sides of said lower portion of said side wall and a first lip and a second lip formed on opposed sides of said upper portion of said tamper indicating band, a combination of said first lip and second lip and said tamper indicating band and a combination of said first lip and second lip and said side wall each having a same first thickness, said first thickness greater than said lower portion of said side wall and said upper portion of tamper indicating band, said tamper indicating band also having an inwardly directed retention mechanism.

14. A closure with a tamper indicating band, comprising:

a top wall and depending side wall frangibly connected to a tamper indicating band, said tamper indicating band having an upper portion, said side wall having a lower portion, a first lip and second lip formed on said lower portion of said side wall and a first lip and second lip formed on said upper portion of said tamper indicating band, said first lip on said tamper indicating band and said first lip on said lower portion of said side wall extending inwardly therefrom, said second lip on said tamper indicating band and said second lip on said lower portion of said side wall extending outwardly therefrom, a combination of said first lip and said second lip and said tamper indicating band and a combination of said first lip and said second lip and said side wall having a first thickness, said first thickness greater than said lower portion of said side wall and said upper portion of tamper indicating band, said tamper indicating band also having an inwardly directed retention mechanism.

15. The closure of claim 14 further comprising a plurality of vertical ribs formed on an interior surface of said side wall and said tamper indicating band, said vertical ribs frangibly connecting said tamper indicating band to said lower portion of said side wall.

16. The closure of claim 15 wherein said tamper indicating band and said lower portion of said side wall are separated by a continuous circumferential groove.

17. The closure of claim 14 wherein said retention mechanism on said tamper indicating band is a plurality of inwardly and upwardly directed fingers.

* * * * *

UNITED STATES PATENT AND TRADEMARK OFFICE

CERTIFICATE OF CORRECTION

PATENT NO. : 6,568,548 B1 
DATED : May 27, 2003
INVENTOR(S) : Jeffrey C. Minnette and Gary V. Montgomery It is certified that error appears in the above-identified patent and that said Letters Patent is hereby corrected as shown below:

Column 6,
Line 46, after "and said" insert -- upper portion of --.

Signed and Sealed this

Twenty-second Day of June, 2004

JON W. DUDAS
*Acting Director of the United States Patent and Trademark Office*